US008646178B2

(12) United States Patent
Crişi et al.

(10) Patent No.: US 8,646,178 B2
(45) Date of Patent: Feb. 11, 2014

(54) HEAT EXCHANGER FABRICATION WITH IMPROVED THERMAL EXCHANGE EFFICIENCY

(75) Inventors: Aldo Crişi, Turin (IT); Luca Campagna, Turin (IT); Silvio Giors, Turin (IT)

(73) Assignee: Agilent Technologies, Inc., Santa Clara, CA (US)

( * ) Notice: Subject to any disclaimer, the term of this patent is extended or adjusted under 35 U.S.C. 154(b) by 413 days.

(21) Appl. No.: 12/956,477

(22) Filed: Nov. 30, 2010

(65) Prior Publication Data

US 2011/0126411 A1 Jun. 2, 2011

(30) Foreign Application Priority Data

Dec. 1, 2009 (IT) ..... TO2009A0946

(51) Int. Cl.

| | |
|---|---|
| ***B21D 53/02*** | (2006.01) |
| ***B21D 53/06*** | (2006.01) |
| ***B21D 51/24*** | (2006.01) |
| ***B21D 39/20*** | (2006.01) |
| ***B23P 15/26*** | (2006.01) |

(52) U.S. Cl.
USPC ..... 29/890.03; 29/890.051; 29/437; 29/505; 29/507; 29/727

(58) Field of Classification Search
USPC ..... 29/890.03, 507, 890.044, 727
See application file for complete search history.

(56) References Cited

U.S. PATENT DOCUMENTS

| | | | | |
|---|---|---|---|---|
| 1,930,942 | A | 10/1933 | Pringle | |
| 3,449,812 | A * | 6/1969 | Ebbinghaus et al. | 29/890.044 |
| 4,076,287 | A * | 2/1978 | Bill et al. | 285/382.4 |
| 4,083,093 | A * | 4/1978 | Chertok | 29/890.033 |
| 4,142,581 | A * | 3/1979 | Yoshitomi et al. | 165/173 |
| 4,300,275 | A | 11/1981 | McLaughlin | |
| 5,484,015 | A * | 1/1996 | Kyees | 165/168 |
| 5,636,684 | A | 6/1997 | Teytu et al. | |
| 6,082,353 | A | 7/2000 | van Doorn | |
| 8,261,567 | B2 * | 9/2012 | Zangari et al. | 62/255 |
| 8,316,842 | B2 * | 11/2012 | Guryevskiy et al. | 126/651 |

FOREIGN PATENT DOCUMENTS

| | | | |
|---|---|---|---|
| DE | 3908966 | A1 | 9/1990 |
| DE | 102006037065 | A1 | 2/2008 |
| EP | 0810657 | A2 | 3/1997 |
| WO | 2009136277 | A1 | 11/2009 |

OTHER PUBLICATIONS

European Search Report and Written Opinion From Parent Application No. IT TO20090946, Jun. 24, 2010 (10 pgs).

* cited by examiner

*Primary Examiner* — David Bryant
*Assistant Examiner* — Jun Yoo

(57) ABSTRACT

In a method for fabricating a heat exchanger, a metal body includes a bore and inlet and outlet connectors fitted to the body at respective inlet and outlet ends of the bore. The connectors each include an inner surface in which annular grooves are formed. A tube is inserted in the bore such that inlet and outlet ends of the tube are respectively located in the inlet and outlet connectors. A mandrel is operated to expand at least a portion of the tube into contact with the body, and to expand the inlet and outlet tube ends into contact with the grooves of the inlet and outlet connectors, respectively. The heat exchanger provides improved thermal exchange efficiency between the tube and the body, and fluid-tight connections between the tube and the inlet and outlet connectors.

13 Claims, 7 Drawing Sheets

HEAT EXCHANGER FABRICATION WITH IMPROVED THERMAL EXCHANGE EFFICIENCY

RELATED APPLICATIONS

This application claims priority to Italian Patent Application No. TO2009A000946, filed Dec. 1, 2009; the content of which is incorporated by reference herein in its entirety.

TECHNICAL FIELD

The present invention concerns the fabrication of heat exchangers with improved thermal exchange efficiency, particularly in the thermal exchange between a metal body and a tube through which a heat exchange fluid flows, and particularly where the tube is of a different material than the metal body. The present invention finds application, for example, in cooling the body of a vacuum pump, for instance a turbomolecular vacuum pump.

BACKGROUND

Several applications exist in which it is necessary to cool the metal body of a machine, device, component, or other type of heat exchanger during its operation to maintain its temperature below a predetermined threshold. For instance, the body of a turbomolecular vacuum pump, typically made of aluminum or aluminum alloys, is constantly cooled during the pump operation to maintain its temperature below a predetermined threshold.

Different methods are known for cooling the aluminum body of a turbomolecular vacuum pump by using low temperature water flowing in the body. In certain prior art applications, the channels through which the cooling fluid flows are directly formed in the pump body by drilling rectilinear (i.e., straight and/or perpendicular) branches connected in series and, at the outer surface of the body, the channels are connected to a circuit of the cooling water by means of inlet and outlet hydraulic connectors made of stainless steel. Even though such a solution is economical and avoids introducing thermal resistance between the fluid and the body, it has a number of drawbacks. First, it is very difficult to obtain large thermal exchange surfaces in an inexpensive manner due to the constraints imposed by the drilling. Moreover, the coupling between the channels made of aluminum and the connectors made of a different material, in the presence of water, induces galvanic corrosion of the aluminum, and this entails the risk that the corrosion products obstruct the channels for the cooling water. Aluminum corrosion moreover can etch and obstruct the channel in the case of non-treated cooling water and/or the occurrence of galvanic couples between different sections of the cooling circuit. Making anodized channels avoids the drawbacks related to aluminum corrosion yet it entails an increase in the complexity of the manufacturing process and, consequently, in the production costs, and in any case it does not allow obtaining large thermal exchange surfaces because it relies on the same geometry as the channels made by drilling.

In other prior art applications, cooling water ducts made of stainless steel are inserted into the pump body made of aluminum when the latter is manufactured. Insertion takes place by means of a co-melting process, i.e. the steel channel is introduced into the mold into which molten metal intended to form the body is poured. Such a solution allows obtaining large thermal exchange surfaces and avoids the corrosion problems. Yet, the co-melting process is complex and expensive. Moreover, such a process does not ensure a good thermal contact between the pump body and the ducts for the cooling fluid, due to the different thermal expansion coefficients and the different temperatures of the materials during cooling, which entails different shrinkages. Thus, notwithstanding the large thermal exchange surface, the yield of the thermal exchange is not always repeatable.

Further, in other prior art applications, cooling water tubes or channels made of copper or copper alloys are placed near the pump body made of aluminum and are secured thereto by interference driving, screwing or gluing. Even though such a solution exploits the high thermal conductivity of the tubes of copper or copper alloy, it is not free from problems of galvanic corrosion between copper and aluminum. Moreover, securing copper tubes to the pump body of aluminum entails technical problems or requires solutions that are expensive or are characterized by scarce process repeatability.

On the other hand, in the technology of heat exchangers with tubes and skirt, expansion by mandrel ("expansion") of the tubes on the tube plates is utilized. Referring to FIG. 1, a mandrel 101 includes a rotating element 103, driven for instance by a pneumatic motor, causing the axial forward movement of a conical pin 105. The conical pin 105, while moving forward and rotating, pushes in radial direction a plurality of rollers 107 uniformly arranged along the axis of the mandrel 101, which at the same time is made to rotate by the pin 105. The radial and rotary motion of the rollers 107 causes a gradual enlargement of the tube in which the mandrel 101 is inserted, which enlargement is accompanied by a plastic deformation of the tube itself.

In the prior art, expansion is a commonly used operation when connecting the tubes of the heat exchangers to the tube plates. The tube plates are bored plates, which are placed along the tubes with a certain mutual spacing and through which the tubes pass, the plates having a much smaller thickness than the length of the tubes passing through them. In coupling the tubes of a heat exchanger with the tube plates, good quality of the contact between the tubes and the plates ensured by the expansion is sought for, so as to ensure a good robustness in tube positioning and the maintenance of a proper mutual position, eliminate the drawbacks related with vibrations, and also ensure hydraulic sealing between tubes and plates.

Yet, the prior art does not teach using expansion to improve the efficiency of thermal exchange between a metal body and a circuit for a heat exchange fluid inserted in the body for cooling/heating it.

Accordingly, there is a need for fabricating heat exchangers, particularly of the type which entail thermal exchange between a tube and a metal body. There is also a need for providing a method for improving the efficiency of thermal exchange between a metal body to be cooled/heated and a tube through which a cooling/heating fluid flows. There is also a need for providing a method for cooling/heating a metal body that avoids problems arising from the contact between the body and the cooling/heating fluid and from corrosion of the body due to the interposition of a tube of different material, without worsening the contact thermal resistance. There is also a need for providing fluid-tight connections between a heat exchanger and an associated circuit through which heat exchanging fluid flows to and/or from the heat exchanger.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one implementation, a method is provided for fabricating a heat exchanger. A metal body is provided that includes a bore extending through the metal body, an inlet hydraulic connector fitted to the body at an inlet end of the bore, and an outlet hydraulic connector fitted to the body at an outlet end of the bore. The inlet hydraulic connector and the outlet hydraulic connector each include an inner surface in which a plurality of annular grooves is formed. A tube is inserted in the bore such that the tube is surrounded by a wall of the body defining the bore, an inlet end of the tube is located in the inlet hydraulic connector, and an outlet end of the tube is located in the outlet hydraulic connector. A mandrel is operated to expand at least a portion of the tube into contact with the wall, to expand the inlet end of the tube into contact with the inner surface and the annular grooves of the inlet hydraulic connector, and to expand the outlet end of the tube into contact with the inner surface and the annular grooves of the outlet hydraulic connector, wherein a fluid-tight connection is made between the tube and the inlet hydraulic connector and between the tube and the outlet hydraulic connector.

According to another implementation, the portion of the tube that is expanded is greater than 10% of a total length of the tube. In another implementation, the portion of the tube that is expanded is greater than 30% of a total length of the tube.

In some implementations, expansion of the portion of the tube, the inlet end of the tube, and the outlet end of the tube continues until achieving plastic deformation and a reduction in thickness of the tube, the inlet end of the tube, and the outlet end of the tube.

In some implementations, the inlet end and outlet end of the tube are expanded so as to cause edges of the respective annular grooves of the inner hydraulic connector and the outer hydraulic connector to cut into an external surface of the tube at the respective inlet end and outlet end of the tube.

According to another implementation, the bore comprises a plurality of rectilinear bore sections, the tube comprises a plurality of rectilinear tube sections, and inserting the tube in the bore includes inserting the tube sections in the corresponding bore sections.

According to another implementation, the tube sections are connected in series by joints to establish a fluid flow path from one tube section to another tube section via the corresponding joint. Each joint includes a joint opening open to an outer surface of the body. Each joint opening is closed by installing a respective closing member at the joint opening.

According to another implementation, before closing at least one of the joint openings, a mandrel is inserted through the at least one joint opening and into the tube section associated with the at least one joint opening to expand the tube section into contact with the wall.

According to another implementation, each joint comprises an internal surface in which a plurality of annular grooves is formed, and expanding the tube section includes expanding the tube section into contact with the internal surface and the annular grooves of the joint.

According to another implementation, at least two tubes are inserted in one or more bores of the body such that the at least two tubes are connected in series. According to another implementation, at least two tubes are inserted in one or more bores of the body such that the at least two tubes are connected in parallel.

In some implementations, the tube is coated with a layer of malleable material having high thermal conductivity such as, for example, silver.

In some implementations, at least one portion of the tube for the heat exchange fluid, after the tube has been introduced into the body to be cooled/heated, is subjected to an expansion step causing an enlargement of the tube itself and ensuring an excellent adhesion of the tube to a surrounding wall of the metal body. As a result, the efficiency of thermal exchange between the heat exchange fluid flowing through the tube and the metal body is very good in that the contact thermal resistance between the tube and the body is minimized. Moreover, because the expansion can ensure a hydraulic seal, it is possible to avoid any contact between the heat exchange fluid (for instance water) and the metal body in which the tube is expanded and which is susceptible of corrosion.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 2:
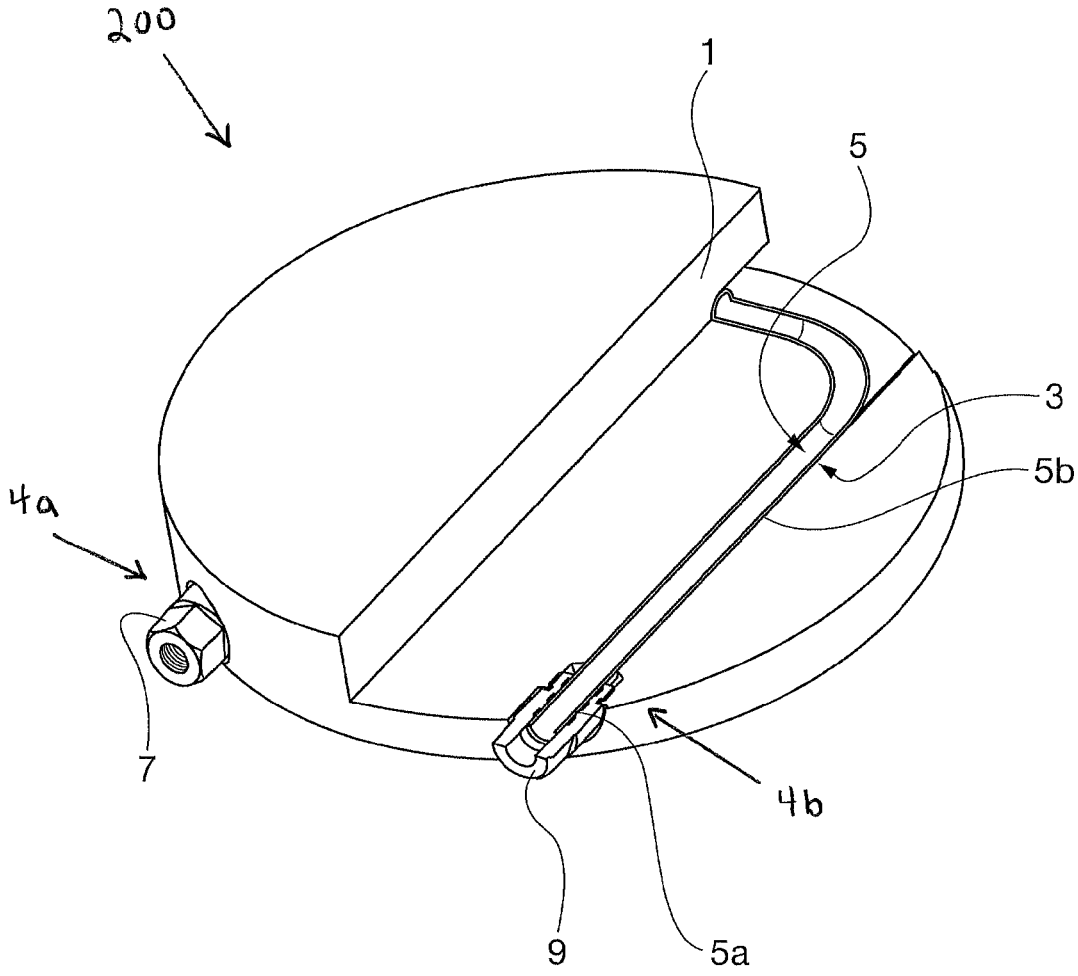
FIG. 2 is a perspective, part-sectional view of an example of a heat exchanger that may be fabricated according to methods disclosed herein.

FIG. 2 is a perspective, part-sectional view of an example of a heat exchanger 200 that may be fabricated according to methods disclosed herein. The heat exchanger 200 is shown at an intermediate stage of fabrication, i.e., before a tube expansion step to be described below. The heat exchanger 200 includes a metal body 1. The body 1 may be, for example, the aluminum body of a turbomolecular vacuum pump. A bore 3 is formed through the body 1 such as by drilling. The bore 3 extends through the body 1 and includes an inlet bore end **4*a*** and an outlet bore end 4*b* open to an outer surface of the body 1. An inlet hydraulic connector 7 is fitted to the body 1 in any suitable manner at the inlet bore end 4*a*, and an outlet hydraulic connector 9 is fitted to the body 1 in any suitable manner at the outlet bore end 4*b*. The inlet hydraulic connector 7 and the outlet hydraulic connector 9 serve as a respective inlet and outlet for cooling fluid to and from an external heat exchange fluid circuit (not shown). One or more tubes or coils 5 through which a cooling fluid, for instance water, can flow are inserted into the bore 3. In the illustrated example, a single tube 5 with a U-shaped profile is provided. Thus, the tube 5 includes inlet and outlet tube ends (only an outlet tube end 5*a* is shown in FIG. 2) and rectilinear tube arms (only one tube arm 5*b* is shown in FIG. 2). In the illustrated example, the tube 5 is wholly contained within the body 1. The tube ends 5*a* of both tube arms 5*b* of the tube 5 are located in correspondence of the outer surface of the body 1 and are connected to the external circuit for directing the cooling fluid through the hydraulic connectors 7, 9 to and from the tube 5, respectively. Thus, the tube ends 5*a* are disposed in the respective hydraulic connectors 7, 9. Generally, the tubes 5 may be housed at least for the major part of their length, or even wholly, inside the corresponding bores 3 formed in body 1. In some advantageous implementations, the tube 5 and hydraulic connectors 7, 9 are made of a corrosion-resistant material, typically stainless steel.

Figure 1:
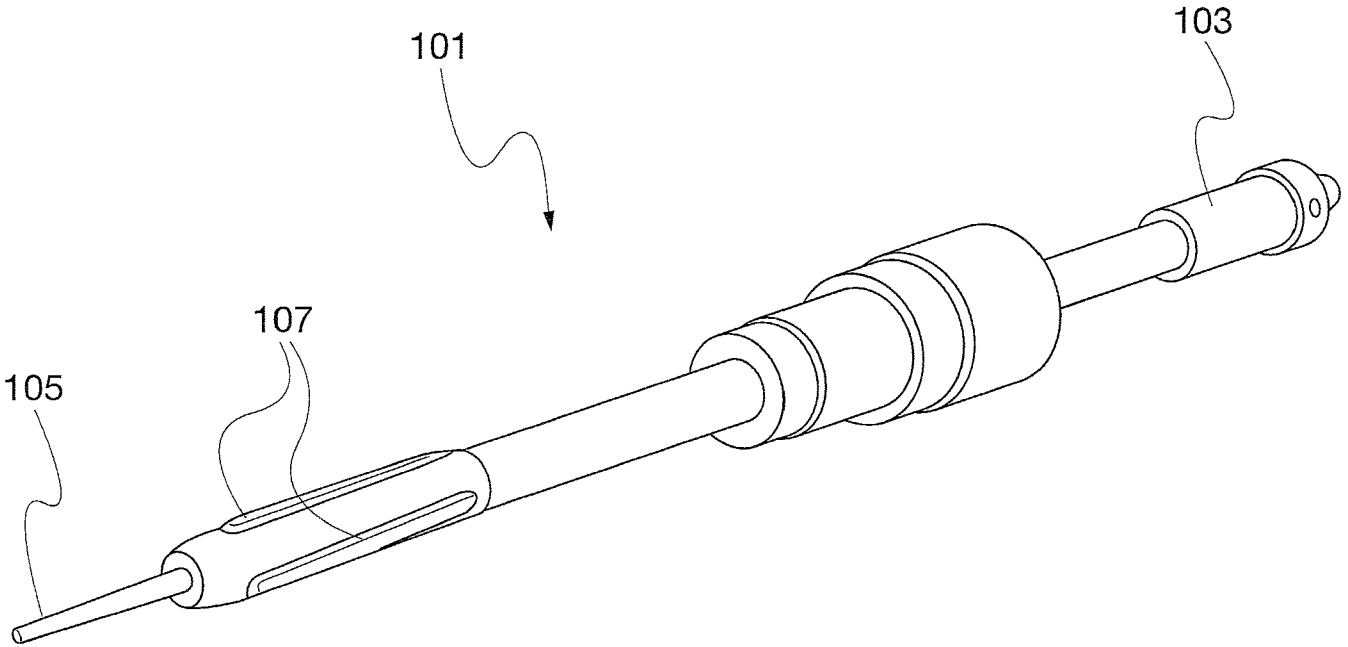
Fig. 1 PRIOR ART
FIG. 1 shows a mandrel of known type.
Figure 3:
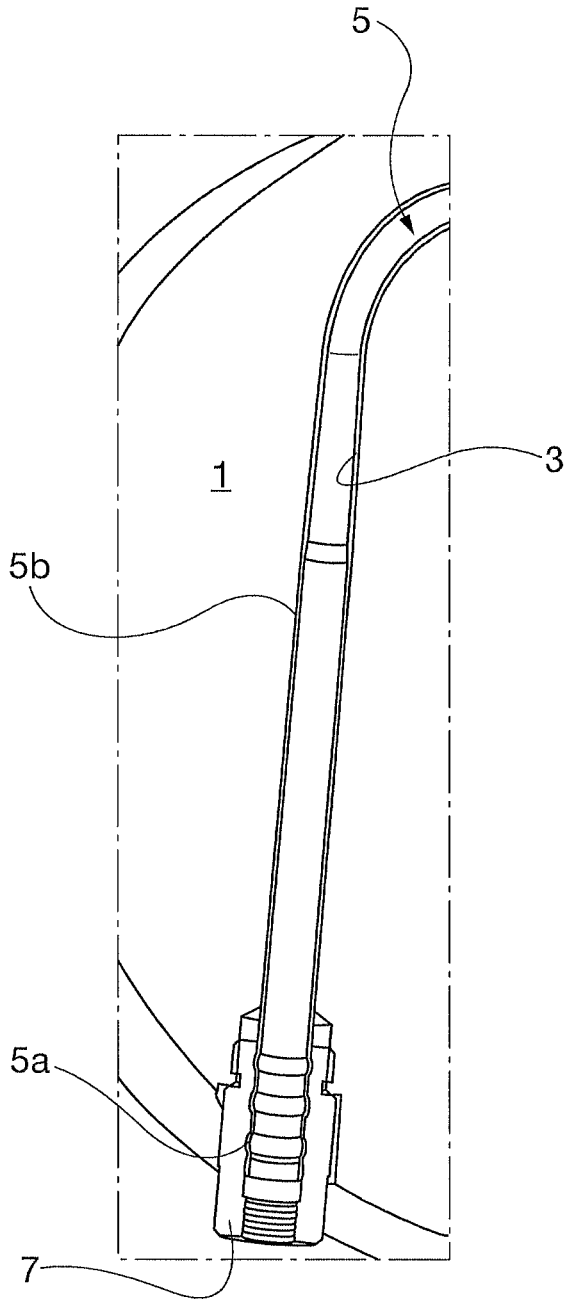
FIG. 3 is a cross-sectional view of a portion of the body illustrated in FIG. 2, after performing a tube expansion step.

FIG. 3 is a cross-sectional view of a portion of the body 1 illustrated in FIG. 2, after performing a tube expansion step. According to the presently described method, a mandrel like that shown in FIG. 1 is introduced along tube arms 5*b* of the tube 5 through hydraulic connectors 7, 9 and tube ends 5*a* of tube 5, and the tube arms 5*b* are subjected to expansion in order to cause an enlargement thereof to such an extent that they come into excellent contact with the surrounding wall of the body 1 that defines the bore 3. In some implementations, the enlargement by expansion of tube 5 is continued until achieving very high contact pressures between the tube 5 and the body 1, on the order of several MPa, and until obtaining a reduction of the thickness of the wall of the tube 5 by plastic deformation.

The method may include subjecting to expansion at least a non-negligible portion of tube 5, in particular a considerable portion of the tube 5, exceeding at least 10% of its overall length and in other advantageous examples exceeding 30% of the overall length.

Figure 2A:
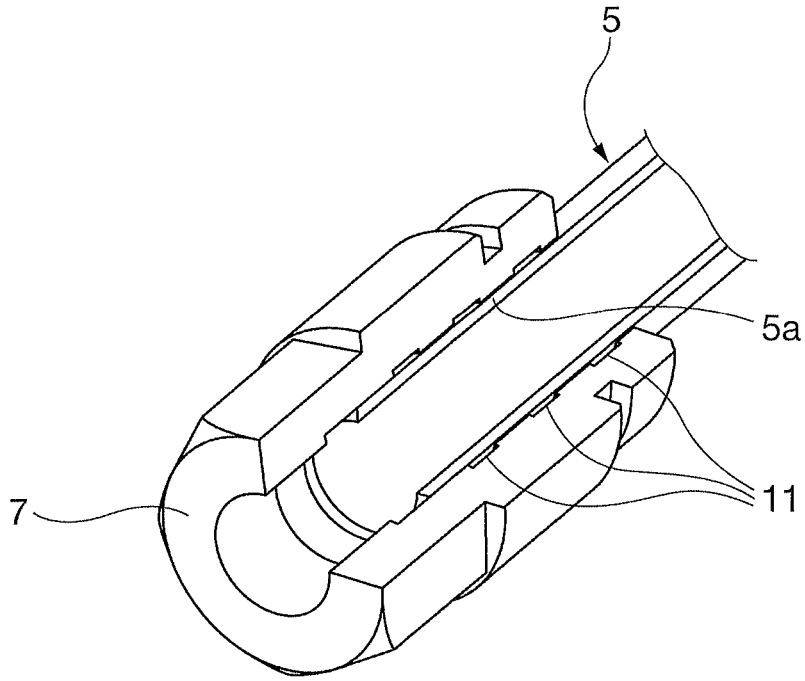
FIG. 2A is a perspective view of a tube end and hydraulic connector of the heat exchanger illustrated in FIG. 2.
Figure 3A:
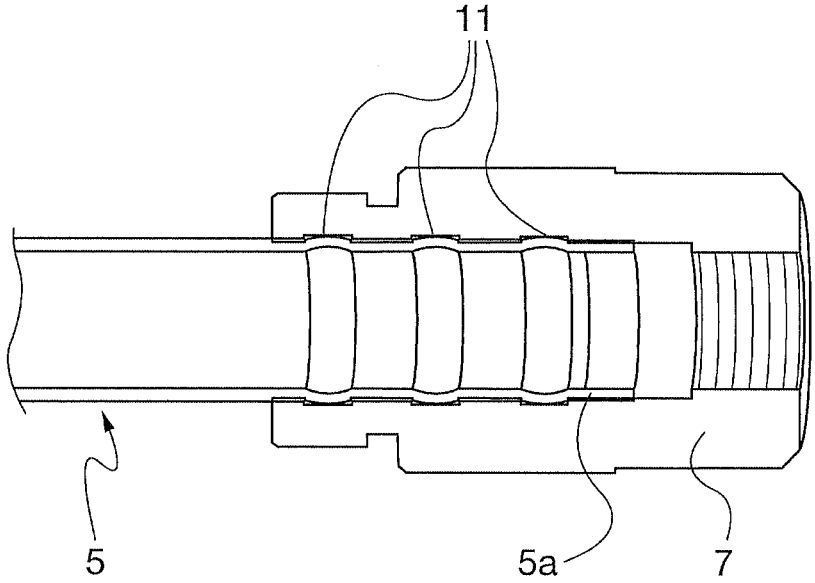
FIG. 3A is a cross-sectional view of the tube end and hydraulic connector illustrated in FIG. 2A, after tube expansion.

In the specific case of the illustrated example, the method may include subjecting the tube arms 5*b* of the tube 5 to expansion over the whole useful rectilinear length that can be reached by the mandrel, as well as expanding the tube ends 5*a* of the tube 5 against the internal walls of the hydraulic connectors 7 and 9. In this respect, and referring to FIGS. 2A and 3A, the hydraulic connectors 7 and 9 are advantageously provided, on their internal surfaces, with a plurality of annular grooves 11. During the expansion step, the tube ends 5*a* of the tube 5 are enlarged until they come into excellent contact with the annular grooves 11, with very high contact pressures, such that the edges of the annular grooves 11 may cut into the external surface of the tube 5. Expansion of the tube 5 against the internal walls of hydraulic connectors 7 and 9, and in particular against the edges of the annular grooves 11, ensures a fluid-tight connection between the tube 5 and the hydraulic connectors 7 and 9 so that the risk of leakage and of contact between the cooling fluid (e.g. water) and the body 1 is avoided. Consequently, all risks of corrosion of the body 1 are avoided, even in a case where the body 1 is made of a material subject to corrosion, such as aluminum in a typical case of the body of a turbomolecular vacuum pump.

Experimental tests have shown that the method as disclosed herein allows considerable improvement in the efficiency of thermal exchange between the cooling fluid and the body 1 to be cooled.

Figure 4:
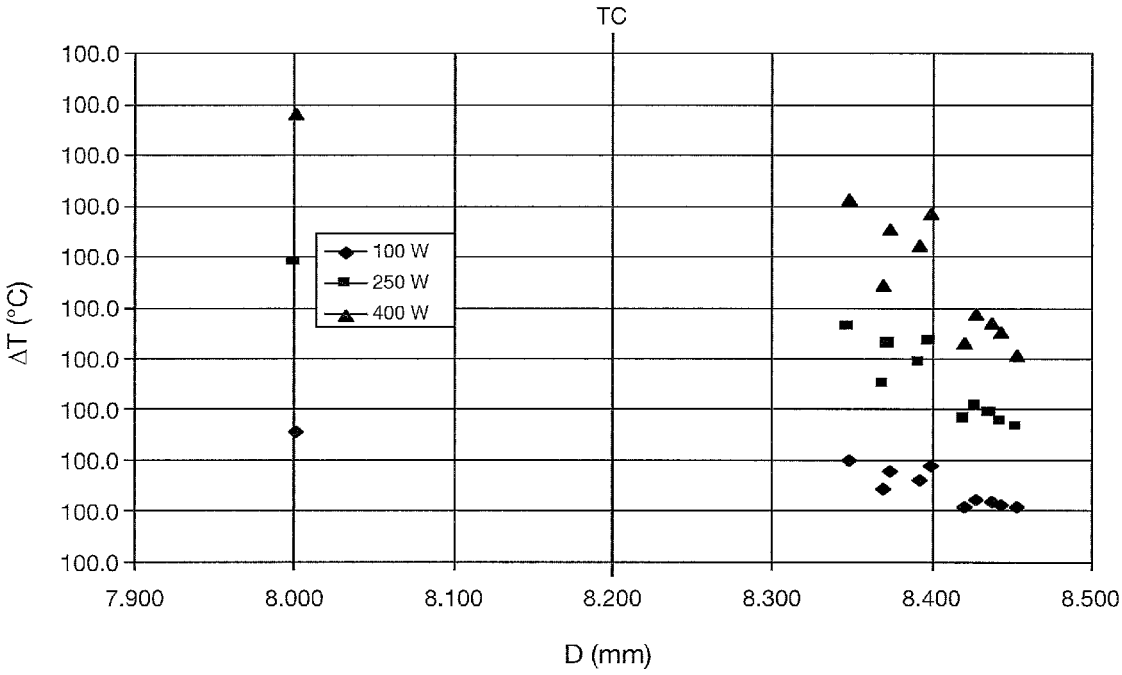
FIG. 4 is a graph showing the temperature difference between a heat exchange fluid and a metal body of the heat exchanger illustrated in FIG. 2, as a function of internal diameter D of tubes for the heat exchange fluid, before and after a tube expansion step.

FIG. 4 is a graph showing the variations of a difference DT between the temperature of the cooling fluid (water), with constant flow rate, measured at the inlet hydraulic connector 7 and the temperature of the body 1 to be cooled, as a function of an internal diameter D of the tube 5 through which the cooling fluid flows, the diameter increasing as the expansion pressure increases. The tests to which FIG. 4 relates have been performed by heating the body 1 by means of electrical resistors with a power of 100 W, 250 W and 400 W, respectively. As apparent from FIG. 4, a bore 3 with diameter 10.2 mm has been drilled in the body 1 and a tube 5 with starting external diameter 10.0 mm and starting internal diameter 8.0 mm has been introduced into the bore 3. Subsequently, according to the method the tube 5 has been subjected to expansion and enlarged beyond the theoretical contact point (TC) with the bore wall, up to an internal diameter in the range of 8.35 to 8.45 mm. The results of the experimental tests reported in FIG. 4 clearly demonstrate the improvement in the thermal exchange between the cooling fluid and the body 1 to be cooled, with a reduction in DT of up to 50% of the starting value computed before expansion. Such results therefore confirm that the method as disclosed herein may be implemented to attain the aims indicated above.

It is to be appreciated that, according to some implementations, in order to further improve the thermal exchange between the body 1 and the tube 5, the tube 5 may be coated, before expansion, with a thin layer of malleable material with a high thermal conductivity, such as for example a silver coating.

Figure 5:
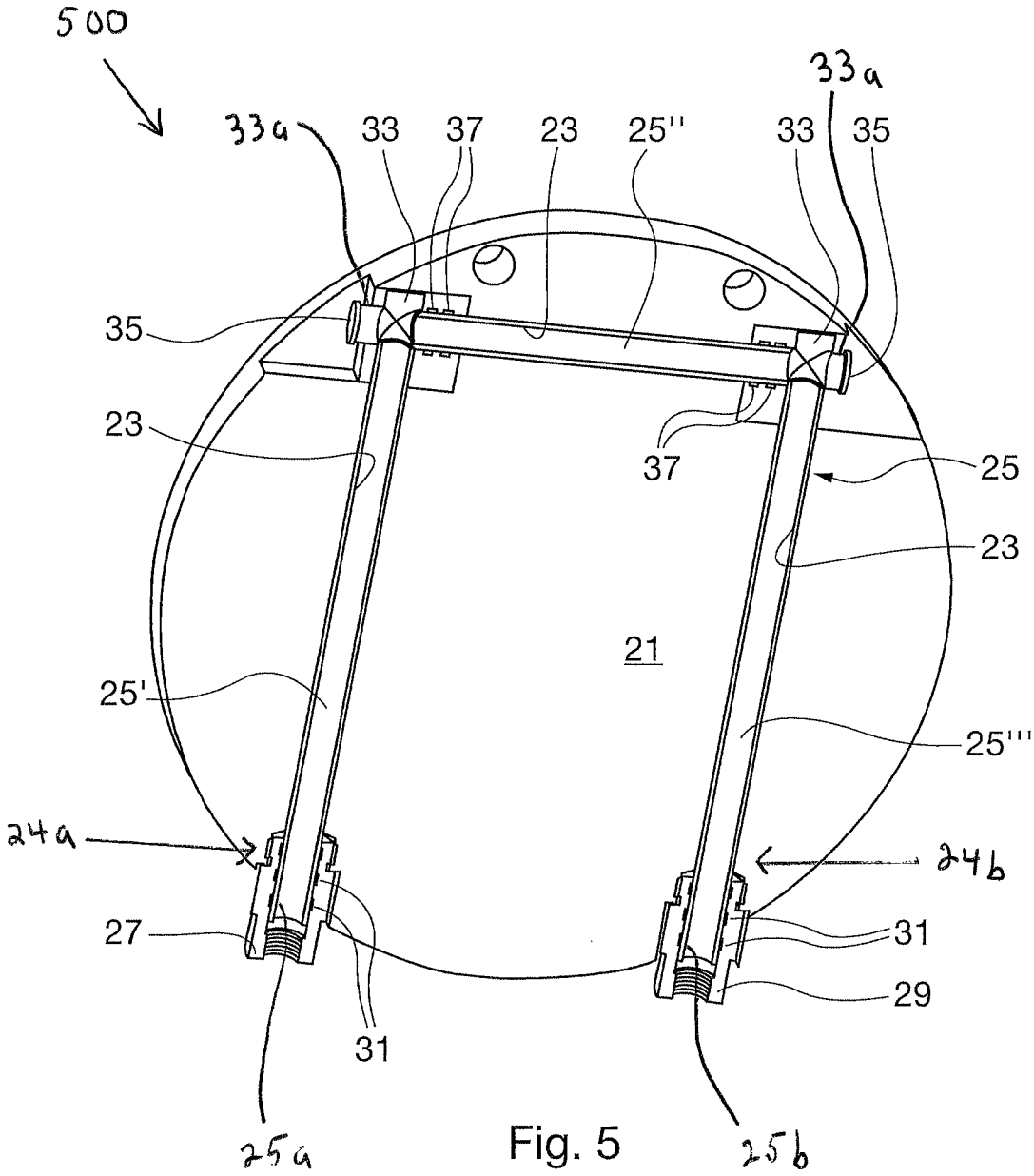
FIG. 5 is a perspective, part-sectional view of another example of a heat exchanger that may be fabricated according to methods disclosed herein.

FIG. 5 is a perspective, part-sectional view of another example of a heat exchanger 500 that may be fabricated according to methods disclosed herein. The implementation of FIG. 5 facilitates increasing the useful length subjected to expansion of the tube through which the cooling fluid flows, as described below.

It is apparent from FIGS. 2 and 3 that, in case a U-shaped tube is used, it is impossible to reach the central portion of the tube and the curvilinear connections between the central portion and the rectilinear arms of the tube by means of a mandrel. Only the rectilinear portions of the tube arms can be subjected to expansion. By comparison, in the implementation shown in FIG. 5, the tube 25 for the cooling fluid comprises a plurality of substantially rectilinear sections 25', 25", 25'". Correspondingly, several rectilinear bore sections 23, each housing a corresponding section 25', 25" or 25'" of the tube 25, are formed in a body 21 to be cooled. All bores 23 open at the external surface of the body 21 and thus are accessible from the outside, including at an inlet bore end 24*a* and an outlet bore end 24*b*.

More particularly, in FIG. 5, the tube 25 comprises a pair of parallel sections 25', 25'", connected at one end to a hydraulic connector 27 serving as a cooling fluid inlet and a hydraulic connector 29 serving as a cooling fluid outlet, respectively. An inlet tube end 25*a* of the tube section 25' is disposed in the inlet hydraulic connector 27 and an outlet tube end 25*b* of the tube section 25'" is disposed in the outlet hydraulic connector 29. The opposite ends of the sections 25', 25'" are connected together by means of a third section 25", also rectilinear and perpendicular to the two other sections 25' and 25'". Joints 33 in the form of small metal blocks with a cross-shaped bore are provided between the different sections 25', 25", 25'" of tube 25 in order to ensure its continuity, thus establishing a fluid flow path from one tube section to another tube section in series. Closing members 35 are provided in correspondence of joints 33 between the different sections 25', 25", 25'" of tube 25 in order to keep the tube 25 separate and protected from the external environment. It is to be appreciated that at least one bore or joint opening 33*a* of at least one joint 33 opens at the external surface of the body 21 so that section 25" can be accessed from the outside by a mandrel for the expansion. The joint opening 33*a* is subsequently closed by the corresponding closing member 35, which may for example be a threaded or pressure-fit fluid-tight cap.

According to the present implementation, rectilinear sections 25', 25", 25'" are first introduced into the respective bores 23. Then, a mandrel like that shown in FIG. 1 is sequentially introduced along the sections 25', 25", 25'" of the tube 25, which can be accessed from the outside through the inlet hydraulic connector 27, the joint opening 33*a* of the joint 33, and the outlet hydraulic connector 29, respectively. The sections 25', 25", 25'" of the tube 25 are then subjected to expansion in order that they are enlarged until coming into excellent contact with the surrounding walls of the bores 23 in the body 21.

It is clear that because each section 25', 25", 25'" is rectilinear and accessible from the outside, the portion of tube 25 that can be subjected to expansion is considerably greater than in the first implementation shown in FIGS. 2 and 3 and may even amount to 100%. Also in this case, the hydraulic connectors 27 and 29 are advantageously provided on their internal surfaces with a plurality of annular grooves 31 in order to ensure a fluid-tight connection with the sections of tube 25 after the latter have been expanded. Similarly, the joints 33 are provided, on their internal surfaces, with a plurality of annular grooves 37 having the same function. Thus, also in this method the risk of leakage and contact between the cooling fluid and the body 21 to be cooled is avoided.

Figure 6:
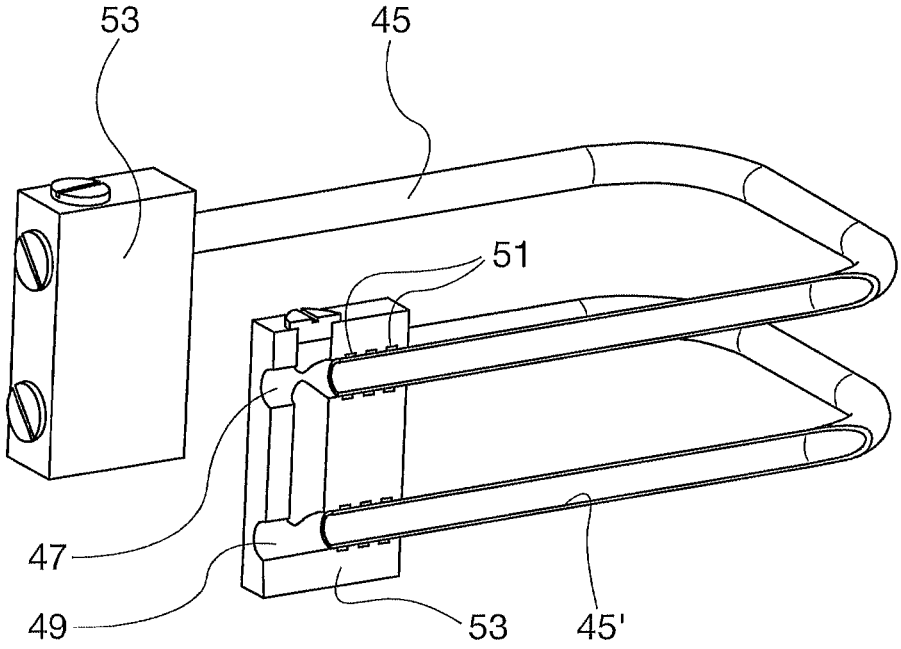
FIG. 6 is a perspective view of an example of an arrangement of more than one tube for heat exchange fluid that may be implemented in a heat exchanger according to implementations disclosed herein.

It will be appreciated that the methods disclosed herein may provide for the use of either a single tube, even of rectilinear shape, or a plurality of tubes, connected in series or in parallel, for the cooling circuit. By way of example, and with reference to FIG. 6, there is shown a portion of a cooling circuit according to another implementation, where two tubes 45, 45' for the cooling fluid, connected in series, are used. In correspondence with a first joint 53, a first end of the first tube 45 is connected to a hydraulic connector 47 serving as a cooling fluid inlet, and a first end of the second tube 45' is connected to a hydraulic connector 49 serving as a cooling fluid outlet. The opposite ends of the first and second tubes 45, 45' are connected in series through the interposition of a second joint 53. In order to ensure tightness, at the ends of tubes 45, 45' the internal walls of the bores formed in joints 53 are advantageously provided with annular grooves 51.

The implementations described above refer, by way of example, to the cooling of a metal body. It will be understood, however, that such an example is in no way limiting and that the same features and the same advantages equally apply in a case of the heating of a metal body.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A method for fabricating a heat exchanger, the method comprising:

providing a metal body defining a bore extending through the metal body, the bore comprising a plurality of rectilinear bore sections, wherein an inlet hydraulic connector is fitted to the body at an inlet end of the bore and an outlet hydraulic connector is fitted to the body at an outlet end of the bore, the inlet hydraulic connector and the outlet hydraulic connector each comprising an inner surface in which a plurality of annular grooves is formed;

inserting a tube into the bore such that the tube is surrounded by a wall of the body defining the bore, the tube comprising a plurality of rectilinear tube sections, wherein an inlet end of the tube is located in the inlet hydraulic connector and an outlet end of the tube is located in the outlet hydraulic connector, and wherein inserting the tube into the bore comprises inserting the tube sections into corresponding bore sections;

operating a mandrel to expand at least a portion of the tube into contact with the wall, to expand the inlet end of the tube into contact with the inner surface and the annular grooves of the inlet hydraulic connector and to expand the outlet end of the tube into contact with the inner surface and the annular grooves of the outlet hydraulic connector, forming a fluid-tight connection between the tube and the inlet hydraulic connector and between the tube and the outlet hydraulic connector;

connecting the tube sections in series by joints to establish a fluid flow path from one tube section to another tube section via the corresponding joint, each joint comprising a joint opening open to an outer surface of the body; and closing each joint opening by installing a respective closing member at the joint opening.

2. The method of claim 1, wherein expanding at least a portion of the tube comprises expanding greater than 10% of a total length of the tube.

3. The method of claim 1, wherein expanding at least a portion of the tube comprises expanding greater than 30% of a total length of the tube.

4. The method of claim 1, further comprising:

continuing to expand the portion of the tube, the inlet end of the tube, and the outlet end of the tube until achieving plastic deformation and a reduction in thickness of the tube, the inlet end of the tube, and the outlet end of the tube.

5. The method of claim 1, wherein the inlet end of the tube and the outlet end of the tube are expanded so as to cause edges of the respective annular grooves of the inner hydraulic connector and the outer hydraulic connector to cut into an external surface of the tube at the respective inlet end and the outlet end of the tube.

6. The method of claim 1, comprising, before closing at least one of the joint openings, inserting the mandrel through the at least one joint opening and into the tube section associated with the at least one joint opening to expand the tube section into contact with the wall.

7. The method of claim 6, wherein each joint comprises an internal surface in which a plurality of annular grooves is formed, and expanding the tube section comprises expanding the tube section into contact with the internal surface and the annular grooves of the joint.

8. The method of claim 1, wherein the tube is coated with a layer of malleable material having high thermal conductivity.

9. The method of claim 8, wherein the malleable material is silver.

10. A method for fabricating a heat exchanger, the method comprising:

forming a plurality of bore sections of a bore through a body of the heat exchanger;

fitting an inlet hydraulic connector to the body at an inlet end of the bore, and fitting an outlet hydraulic connector to the body at an outlet end of the bore, each of the inlet hydraulic connector and the outlet hydraulic connector having an inner surface in which a plurality of annular grooves is formed;

inserting a plurality of rectilinear tube sections of a tube into the plurality of bore sections, respectively, an inlet end of the tube being located in the inlet hydraulic connector and an outlet end of the tube being located in the outlet hydraulic connector; and connecting adjacent tube sections of the plurality of tube sections by a joint to establish a fluid flow path through the tube, the joint comprising a joint opening open to an outer surface of the body; and expanding the inlet end of the tube into contact with the inner surface and the annular grooves of the inlet hydraulic connector, and expanding the outlet end of the tube into contact with the inner surface and the annular grooves of the outlet hydraulic connector to form fluid-tight connections, respectively.

11. The method of claim 10, wherein the inlet end of the tube and the outlet end of the tube are expanded using a mandrel inserted through the joint opening.

12. The method of claim 11, further comprising:

closing the joint opening by installing a respective closing member at the joint opening.

13. The method of claim 10, wherein the joint comprises an internal surface in which a plurality of annular grooves is formed, further comprising:

expanding the adjacent tube sections into contact with the internal surface and the annular grooves of the joint.

* * * * *